US005127965A

United States Patent [19]

Inoue et al.

[11] Patent Number: 5,127,965

[45] Date of Patent: Jul. 7, 1992

[54] FE-NI ALLOY SHEET FOR SHADOW MASK AND METHOD FOR MANUFACTURING SAME

[75] Inventors: Tadashi Inoue; Masayuki Kinoshita; Tomoyoshi Okita, all of Tokyo, Japan

[73] Assignee: NKK Corporation, Tokyo, Japan

[21] Appl. No.: 723,923

[22] Filed: Jul. 1, 1991

[30] Foreign Application Priority Data

Jul. 17, 1990 [JP] Japan ..... 2-187295
Aug. 22, 1990 [JP] Japan ..... 2-218946

[51] Int. Cl.[5] ..... C21D 9/46; C21D 8/00

[52] U.S. Cl. ..... 148/500; 148/336; 148/621; 148/505

[58] Field of Search ..... 148/12 R, 336; 420/94

[56] References Cited

U.S. PATENT DOCUMENTS 4,751,424 6/1988 Tong ..... 420/94
4,769,089 9/1988 Grey ..... 148/12 R

FOREIGN PATENT DOCUMENTS 61-39344 2/1986 Japan .
62-238003 10/1987 Japan .
62-243780 10/1987 Japan .
62-243781 10/1987 Japan .
62-243782 10/1987 Japan .
1-252725 10/1989 Japan ..... 148/12 R
2-175820 7/1990 Japan ..... 148/12 R
2-182828 7/1990 Japan ..... 148/12 R

*Primary Examiner*—Deborah Yee
*Attorney, Agent, or Firm*—Frishauf, Holtz, Goodman & Woodward

[57] ABSTRACT

An Fe-Ni alloy sheet for a shadow mask, which consists essentially of:
nickel: from 34 to 38 wt. %,
silicon: from 0.01 to 0.15 wt. %,
manganese: from 0.01 to 1.00 wt. %, and
the balance being iron and incidental impurities;
the surface portion of the alloy sheet having a silicon (si) segregation rate, as expressed by the following formula, of up to 10%:

$$\left| \frac{\left(\text{Si concentration in segregation region}\right) - \left(\text{average Si concentration}\right)}{(\text{Average Si concentration})} \right| \times 100;$$

and
the alloy sheet having a surface roughness which satisfies all the following formulae (1) to (3):

$$0.3\ \mu m \leqq Ra \leqq 0.8\ \mu m \quad (1)$$

where, Ra: center-line mean roughness;

$$3 \leqq Rkr \leqq 7 \quad (2)$$

where, Rkr: kurtosis which is a sharpness index in the height direction of the roughness curve; and $$Ra \geqq -\frac{1}{15} Rkr + 0.6 \quad (3)$$

The above-mentioned alloy sheet is manufactured by: preparing an alloy sheet, which has the above-mentioned chemical composition, and imparting a surface roughness which satisfies all the above-mentioned formulae (1) to (3) to the both surfaces of the alloy sheet by means of a pair of dull rolls during the final rolling of the alloy sheet for that preparation. The thus manufactured alloy sheet is excellent in etching pierceability and free from seizure of the flat mask during the annealing thereof.

6 Claims, 5 Drawing Sheets

FE-NI ALLOY SHEET FOR SHADOW MASK AND METHOD FOR MANUFACTURING SAME

REFERENCE TO PATENTS, APPLICATIONS AND PUBLICATIONS PERTINENT TO THE INVENTION

As far as we know, there are available the following prior art documents pertinent to the present invention:

(1) Japanese Patent Provisional Publication No. 61-39,344 dated Feb. 25, 1986;

(2) Japanese Patent Provisional Publication No. 62-243,780 dated Oct. 24, 1987;

(3) Japanese Patent Provisional Publication No. 62-243,781 dated Oct. 24, 1987;

(4) Japanese Patent Provisional Publication No. 62-243,782 dated Oct. 24, 1987; and (5) Japanese Patent Provisional Publication No. 62-238,003 dated Oct. 19, 1987.

The contents of the prior arts disclosed in the above-mentioned prior art documents will be discussed hereafter under the heading of the "BACKGROUND OF THE INVENTION".

BACKGROUND OF THE INVENTION

1. Field of the Invention

The present invention relates to an Fe-Ni alloy sheet for a shadow mask used for a color cathode-ray tube and a method for manufacturing same.

2. Related Art Statement

Along with the recent tendency toward a higher-grade color television set, a 36 wt. % Ni-Fe alloy known as the invar alloy is attracting the general attention as an alloy for a shadow mask capable of coping with problems such as a color-phase shift. The invar alloy has a far smaller thermal expansion coefficient as compared with a low-carbon steel conventionally applied as a material for a shadow mask.

By making a shadow mask from the invar alloy, therefore, even heating of the shadow mask by an electron beam would hardly cause such problems as a color-phase shift resulting from thermal expansion of the shadow mask.

However, the invar alloy sheet for a shadow mask, i.e., the original sheet prior to forming by etching passage holes for the electron beam (hereinafter simply referred to as the "holes") has the following problems:

(1) Poor etching pierceability: Because of a high nickel content in the invar alloy, the invar alloy sheet for a shadow mask has, during the etching-piercing, a poor adhesivity of a resist film onto the surface of the invar alloy sheet, and a lower corrosion by an etching solution as compared with a low-carbon steel sheet for a shadow mask. This tends to cause irregularities in the diameter and the shape of the holes pierced by etching, thus leading to a seriously decreased grade of the color cathode-ray tube.

(2) Seizure easily occurring in the annealing of a flat mask: The invar alloy sheet for a shadow mask as pierced by etching, i.e., the flat mask, is press-formed into a curved surface to match with the shape of the cathode-ray tube. To improve press-formability, the flat mask is annealed prior to the press-forming. It is the usual practice, at cathode-ray tube manufacturers, to anneal several tens to several hundreds of flat masks placed one on the top of the other at a temperature of from 810° to 1,100° C., which is considerably higher than the annealing temperature of a flat mask made of a low-carbon steel, with a view to improving productivity.

Since the invar alloy has a high nickel content, it has a higher strength than a low-carbon steel. A flat mask made of the invar alloy must therefore be annealed at a higher temperature than in a flat mask made of a low-carbon steel. As a result, seizure tends to occur in a flat mask made of the invar alloy during the annealing thereof.

For the purpose of solving the problem (1) as described above, the following prior arts are known:

(a) Japanese Patent Provisional Publication No. 61-39,344 discloses limitation of the center-line mean roughness (Ra) of an alloy sheet for a shadow mask within a range of from 0.1 to 0.4 μm (hereinafter referred to as the "prior art 1").

(b) Japanese Patent Provisional Publication No. 62-243,780 discloses limitation of the center-line mean roughness (Ra) of an alloy sheet for a shadow mask within a range of from 0.2 to 0.7 μm, limitation of the average peak interval of the sectional curve representing the surface roughness within a standard length to up to 100 μm, and limitation of the crystal grain size to at least 8.0 as expressed by the grain size number (hereinafter referred to as the "prior art 2").

(c) Japanese Patent Provisional Publication No. 62-243,781 discloses, in addition to the requirements disclosed in the above-mentioned prior art 2, limitation of Re, i.e., the ratio $\alpha_1/\alpha_2$ of the light-passage hole diameter ($\alpha_1$) to the etching hole diameter ($\alpha_2$) to at least 0.9 (hereinafter referred to as the "prior art 3").

(d) Japanese Patent Provisional Publication No. 62-243,782 discloses that the crystal texture of an alloy sheet for a shadow mask is accumulated through a strong cold rolling and a recrystallization annealing, the crystal grain size is limited to at least 8.0 as expressed by the grain size number, and the surface roughness described in the above-mentioned prior art 2 is imparted to the surface of the alloy sheet for a shadow mask by means of the cold rolling with the use of a pair of dull rolls under the reduction ratio within a range of from 3 to 15% (hereinafter referred to as the "prior art 4").

In order to solve the problem (2) as presented above, on the other hand, the following prior art is known:

(e) Japanese Patent Provisional Publication No. 62-238,003 discloses limitation of the center-line mean roughness (Ra) of an alloy sheet for a shadow mask within a range of from 0.2 to 2.0 μm, and limitation of the value of the deviation index (Rsk) in the height direction of the roughness curve to at least 0 (hereinafter referred to as the "prior art 5").

However, the above-mentioned prior arts 1 to 4 have the problem in that while it is possible to improve etching pierceability of the alloy sheet to some extent, it is impossible to prevent seizure of the flat masks occurring during the annealing thereof.

The above-mentioned prior art 5 has, on the other hand, a problem in that, while it is possible to prevent seizure of the flat mask made of a low-carbon steel during the annealing thereof to some extent, it is impossible to prevent seizure during annealing of the flat mask made of the invar alloy which requires a higher annealing temperature than the low-carbon steel.

Under such circumstances, there is a strong demand for the development of an Fe-Ni alloy sheet for a shadow mask, which is excellent in etching pierceability and permits certain prevention of seizure during the annealing of the Fe-Ni alloy sheet, and a method for manufacturing same, but such an alloy sheet and a method for manufacturing same have not as yet been proposed.

SUMMARY OF THE INVENTION

An object of the present invention is therefore to provide an Fe-Ni alloy sheet for a shadow mask, which is excellent in etching pierceability and permits certain prevention of seizure during the annealing of the Fe-Ni alloy sheet, and a method for manufacturing same.

In accordance with one feature of the present invention, there is provided an Fe-Ni alloy sheet for a shadow mask, which consists essentially of:

nickel : from 34 to 38 wt. %, silicon : from 0.01 to 0.15 wt. %, manganese : from 0.01 to 1.00 wt. %, and the balance being iron and incidental impurities;

the surface portion of said alloy sheet having a silicon (Si) segregation rate, as expressed by the following formula, of up to 10%:

$$\left|\frac{\left(\begin{array}{c}\text{Si concentration in}\\ \text{segregation region}\end{array}\right)-\left(\begin{array}{c}\text{average Si}\\ \text{concentration}\end{array}\right)}{(\text{Average Si concentration})}\right| \times 100;$$

and said alloy sheet having a surface roughness which satisfies all the following formulae (1) to (3);

$$0.3\ \mu m \leqq Ra \leqq 0.8\ \mu m \quad (1)$$

where, Ra: center-line mean roughness;

$$3 \leqq Rkr \leqq 7 \quad (2)$$

where, Rkr: Kurtosis which is a sharpness index in the height direction of the roughness curve; and $$Ra \geqq -\frac{1}{15} Rkr + 0.6 \quad (3)$$

Said surface roughness of said alloy sheet may further satisfy at least one of the following formulae (4) to (7):

$$70\ \mu m \leqq Sm \leqq 160\ \mu m \quad (4)$$

where, Sm: average peak interval of the sectional curve, $$\left.\begin{array}{l}|Ra(L) - Ra(C)| \leqq 0.1\ \mu m\\ |Rkr(L) - Rkr(C)| \leqq 0.5\end{array}\right\} \quad (5)$$

where,

Ra(L): center-line mean roughness of said alloy sheet in the rolling direction,

Ra(C): center-line mean roughness of said alloy sheet in the crosswise direction to the rolling direction, Rkr(L): kurtosis of said alloy sheet in the rolling direction, and Rkr(C): kurtosis of said alloy sheet in the crosswise direction to the rolling direction;

$$\left.\begin{array}{l}70\ \mu m \leqq Sm \leqq 160\ \mu m\\ |Ra(L) - Ra(C)| \leqq 0.1\ \mu m\\ |Rkr(L) - Rkr(C)| \leqq 0.5\\ |Sm(L) - Sm(C)| \leqq 5.0\ \mu m\end{array}\right\} \quad (6)$$

where,

Sm: average peak interval of the sectional curve,

Ra(L): center-line mean roughness of said alloy sheet in the rolling direction,

Ra(C): center-line mean roughness of said alloy sheet in the crosswise direction to the rolling direction, Rkr(L): kurtosis of said alloy sheet in the rolling direction, Rkr(C): kurtosis of said alloy sheet in the crosswise direction to the rolling direction, Sm(L): average peak interval of said alloy sheet in the rolling direction, and Sm(C): average peak interval of said alloy sheet in the crosswise direction to the rolling direction; and $$0.03\ \text{radian} \leqq R\theta a \leqq 0.05\ \text{radian} \quad (7)$$

where, $R\theta a$: average angle of inclination of the roughness curve.

In accordance with another feature of the present invention, there is provided a method for manufacturing an Fe-Ni alloy sheet for a shadow mask, which comprises the steps of:

preparing an Fe-Ni alloy sheet consisting essentially of:

nickel: from 34 to 38 wt. %, silicon: from 0.01 to 0.15 wt. %, manganese: from 0.01 to 1.00 wt. %, and the balance being iron and incidental impurities;

adjusting a silicon (Si) segregation rate, as expressed by the following formula, of the surface portion of said alloy sheet during said preparation of said alloy sheet to up to 10%:

$$\left|\frac{\left(\begin{array}{c}\text{Si concentration in}\\ \text{segregation region}\end{array}\right)-\left(\begin{array}{c}\text{average Si}\\ \text{concentration}\end{array}\right)}{(\text{Average Si concentration})}\right| \times 100;$$

and imparting a surface roughness which satisfies all the following formulae (1) to (3) to the both surfaces of said alloy sheet by means of a pair of dull rolls during the final rolling of said alloy sheet for said preparation:

$$0.3\ \mu m \leqq Ra \leqq 0.8\ \mu m \quad (1)$$

where, Ra: center-line mean roughness;

$$3 \leqq Rkr \leqq 7 \quad (2)$$

where, Rkr: kurtosis which is a sharpness index in the height direction of the roughness curve; and $$Ra \geqq -\frac{1}{15} Rkr + 0.6 \quad (3)$$

In accordance with further another feature of the present invention, there is provided a method for manufacturing an Fe-Ni alloy sheet for a shadow mask, which comprises the steps of:

preparing an Fe-Ni alloy sheet consisting essentially of:

nickel: from 34 to 38 wt. %, silicon: from 0.01 to 0.15 wt. %, manganese: from 0.01 to 1.00 wt. %, and the balance being iron and incidental impurities;

adjusting a silicon (Si) segregation rate, as expressed by the following formula, of the surface portion of said alloy sheet during said preparation of said alloy sheet to up to 10%:

$$\left|\frac{\left(\begin{array}{c}\text{Si concentration in}\\ \text{segregation region}\end{array}\right)-\left(\begin{array}{c}\text{average Si}\\ \text{concentration}\end{array}\right)}{(\text{Average Si concentration})}\right| \times 100;$$

imparting a surface roughness which satisfies all the following formulae (1) to (3) to the both surfaces of said alloy sheet by means of a pair of dull rolls during the final rolling of said alloy sheet for said preparation:

$$0.3\ \mu m \leqq Ra \leqq 0.8\ \mu m \quad (1)$$

where, Ra: center-line mean roughness;

$$3 \leqq Rkr \leqq 7 \quad (2)$$

where, Rkr: kurtosis which is a sharpness index in the height direction of the roughness curve; and $$Ra \geqq -\frac{1}{15} Rkr + 0.6 \quad (3)$$

and said surface roughness further satisfying at least one of the following formulae (4) to (7):

$$70\ \mu m \leqq Sm \leqq 160\ \mu m \quad (4)$$

where, Sm: average peak interval of the sectional curve, $$\left.\begin{array}{l}|Ra(L) - Ra(C)| \leqq 0.1\ \mu m\\ |Rkr(L) - Rkr(C)| \leqq 0.5\end{array}\right\} \quad (5)$$

where,

Ra(L): center-line mean roughness of said alloy sheet in the rolling direction,

Ra(C): center-line mean roughness of said alloy sheet in the crosswise direction to the rolling direction, Rkr(L): kurtosis of said alloy sheet in the rolling direction, and Rkr(C): kurtosis of said alloy sheet in the crosswise direction to the rolling direction;

$$\left.\begin{array}{l}70\ \mu m \leqq Sm \leqq 160\ \mu m\\ |Ra(L) - Ra(C)| \leqq 0.1\ \mu m\\ |Rkr(L) - Rkr(C)| \leqq 0.5\\ |Sm(L) - Sm(C)| \leqq 5.0\ \mu m\end{array}\right\} \quad (6)$$

where,

Sm: average peak interval of the sectional curve,

Ra(L): center-line mean roughness of said alloy sheet in the rolling direction,

Ra(C): center-line mean roughness of said alloy sheet in the crosswise direction to the rolling direction, Rkr(L): kurtosis of said alloy sheet in the rolling direction, Rkr(C): kurtosis of said alloy sheet in the crosswise direction to the rolling direction, Sm(L): average peak interval of said alloy sheet in the rolling direction, and Sm(C): average peak interval of said alloy sheet in the crosswise direction to the rolling direction; and $$0.03\ \text{radian} \leqq R\theta a \leqq 0.05\ \text{radian} \quad (7)$$

where, $R\theta a$: average angle of inclination of the roughness curve.

Said final rolling may be a cold rolling or a temper rolling.

DETAILED DESCRIPTION OF PREFERRED EMBODIMENTS

Figure 1:
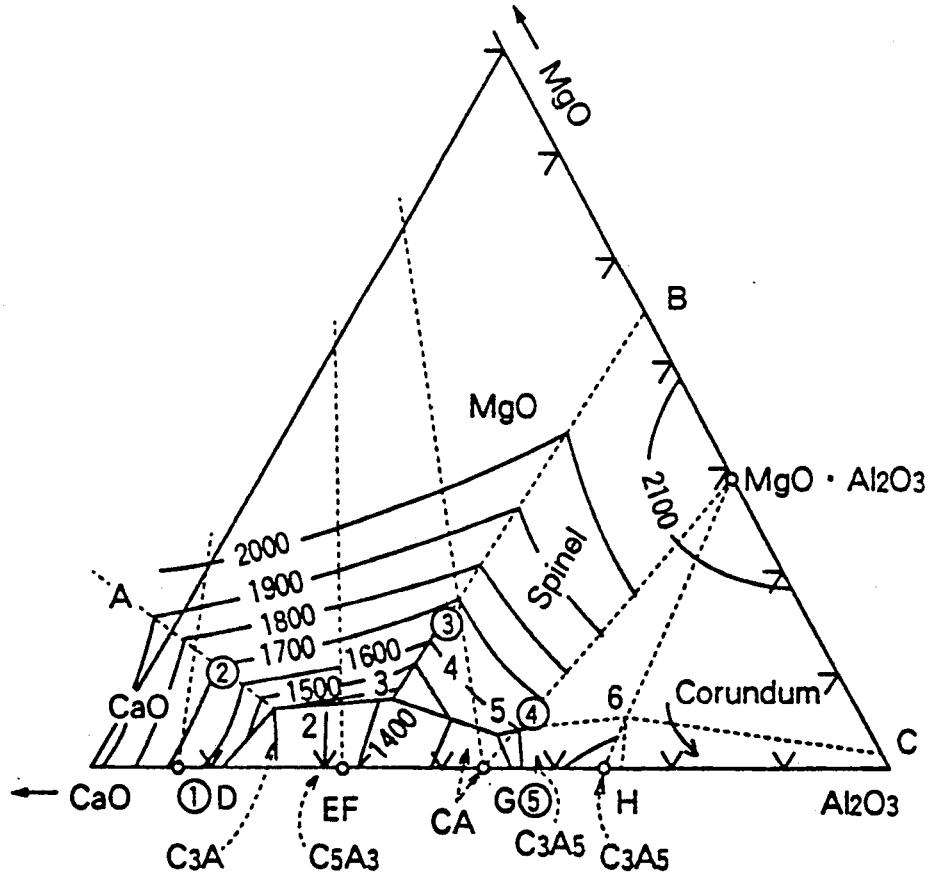
FIG. 1 is a part of the $CaO$-$Al_2O_3$-$MgO$ ternary diagram illustrating the region of the chemical composition of non-metallic inclusions contained in the Fe-Ni alloy sheet for a shadow mask of the present invention, which shows the region of the chemical composition of the non-metallic inclusions, entanglement of which into the Fe-Ni alloy sheet is not desirable.

From the above-mentioned point of view, extensive studies were carried out to develop an Fe-Ni alloy sheet for a shadow mask, which is excellent in etching pierceability and permits certain prevention of seizure during the annealing of the Fe-Ni alloy sheet.

As a result, the following findings were obtained: By adjusting the chemical composition, the silicon segregation rate and the surface roughness of an Fe-Ni alloy sheet for a shadow mask within prescribed ranges, it is possible to obtain an Fe-Ni alloy sheet for shadow mask excellent in etching pierceability and permitting certain prevention of seizure during the annealing of the Fe-Ni alloy sheet.

In addition, the following findings were also obtained: In order to certainly impart a prescribed surface roughness to an Fe-Ni alloy sheet for a shadow mask having a prescribed chemical composition and a prescribed silicon segregation rate, it suffices to prepare the above-mentioned alloy sheet, and impart the prescribed surface roughness onto the both surfaces of the alloy sheet with the use of a pair of dull rolls during the final cold rolling or the final temper rolling, i.e., during the final rolling carried out for the purpose of that preparation.

The present invention was made on the basis of the above-mentioned findings. Now, the Fe-Ni alloy sheet for a shadow mask of the present invention is described further in detail.

The chemical composition of the Fe-Ni alloy sheet for a shadow mask of the present invention is limited within the above-mentioned ranges for the following reasons.

(1) Nickel:

The Fe-Ni alloy sheet for a shadow mask is required to have the upper limit of about $2.0\times10^{-6}$/°C. of an average thermal expansion coefficient in a temperature region of from 30° to 100° C. in order to prevent the occurrence of a color-phase shift. This thermal expansion coefficient depends upon the nickel content in the alloy sheet. The nickel content which satisfies the above-mentioned condition of the average thermal expansion coefficient is within a range of from 34 to 38 wt. %. The nickel content should therefore be limited within a range of from 34 to 38 wt. %.

(2) Silicon:

Silicon is an element effective for the prevention of seizure of a flat mask made from the Fe-Ni alloy sheet for a shadow mask during the annealing of the flat mask. With a silicon content of under 0.01 wt. %, however, an oxide film effective for preventing seizure of the flat mask is not formed on the surface of the flat mask. With a silicon content of over 0.15 wt. %, on the other hand, pierceability of the Fe-Ni alloy sheet is deteriorated. The silicon content should therefore be limited within a range of from 0.01 to 0.15 wt. %.

(3) Manganese:

Manganese has a function of improving deoxidation and hot workability of the Fe-Ni alloy sheet for a shadow mask. With a manganese content of under 0.01 wt. %, however, a desired effect as described above is not available. A manganese content of over 1.00 wt. % leads, on the other hand, to a higher thermal expansion of the Fe-Ni alloy sheet, coefficient, which is not desirable in terms of a color-phase shift of the shadow mask. The manganese content should therefore be limited within a range of from 0.01 to 1.00 wt. %.

Even with a silicon content within the above-mentioned range, an excessively high silicon segregation rate on the surface portion of the Fe-Ni alloy sheet for a shadow mask results in a lower etching pierceability and occurrence of seizure on part of the surface of the flat mask during the annealing thereof In order to prevent seizure of the flat mask, therefore, it is necessary, in addition to limiting the silicon content, to limit a silicon segregation rate, as represented by the following formula, of the surface portion of the Fe-Ni alloy sheet to up to 10%:

$$\left|\frac{\left(\begin{matrix}\text{Si concentration in}\\ \text{segregation region}\end{matrix}\right)-\left(\begin{matrix}\text{average Si}\\ \text{concentration}\end{matrix}\right)}{(\text{Average Si concentration})}\right|\times 100;$$

After limiting the silicon segregation rate to up to 10% as described above, by limiting the minimum value of the silicon concentration in the unit surface portion of the Fe-Ni alloy sheet to at least 0.01 wt. % and the maximum value of the silicon concentration to up to 0.15 wt. %, it is possible to more certainly prevent local deterioration of etching pierceability and local seizure during the annealing.

For the reduction of the silicon segregation rate to up to 10%, the following method is conceivable; heating an alloy ingot or a continuously cast alloy slab to a temperature of 1,200° C. for 20 hours, then subjecting same to a primary slabbing at a sectional reduction rate of from 20 to 60%, then, heating the thus rolled slab to a temperature of 1,200° C. for 20 hours, then subjecting same to a secondary slabbing at a sectional reduction rate of from 30 to 50%, and slowly cooling same.

By subjecting the ingot or the slab to the working treatment and the heat treatment as described above, it is possible to reduce the silicon segregation rate of the Fe-Ni alloy sheet for a shadow mask.

In the heating before the primary slabbing and the secondary slabbing as described above, surface flaws of the slab after the slabbing can be minimized by reducing the sulfur content in the heating atmosphere to up to 80 ppm to inhibit a grain boundary embrittlement occurring during the heating.

The Fe-Ni alloy sheet for a shadow mask of the present invention is not limited to that manufactured through the process as described above alone, but may be one manufactured by the process known as a strip casting which comprises manufacturing an alloy sheet directly from a molten alloy, or one manufactured by applying a slight reduction in hot to the alloy sheet manufactured by the strip casting.

By using the alloy sheet manufactured by the strip casting, the process for reducing the silicon segregation rate through heating and soaking in the above-mentioned case of slabbing can be simplified to some extent.

For the purpose of improving etching pierceability of the Fe-Ni alloy sheet for a shadow mask, particularly the quality of the hole surface after piercing, and minimizing contamination of the etching solution in the etching step to improve the etching operability, it is preferable to adjust the chemical composition of non-metallic inclusions contained in the Fe-Ni alloy sheet having the above-mentioned chemical composition to a chemical composition outside the region surrounded by a pentagon formed by connecting points ①, ②, ③, ④ and ⑤ in the $Al_2O_3$-CaO-MgO ternary phase diagram shown in FIG. 1.

By thus adjusting the chemical composition of the non-metallic inclusions, the non-metallic inclusions in the Fe-Ni alloy sheet for a shadow mask become mainly comprised spherical non-metallic inclusions smaller than 3 μm, and thus the amount of linear non-metallic inclusions having malleability in the rolling direction becomes very slight. As a result, this inhibits the formation of pits on the hole surface, caused by non-metallic inclusions during the etching-piercing, and minimizes the problem of contamination of the etching solution caused by the entanglement of the non-metallic inclusions into the etching solution.

Now, the reasons of limiting a center-line mean roughness (Ra) and a kurtosis (Rkr) of the Fe-Ni alloy sheet for a shadow mask, and the relationship between the center-line mean roughness (Ra) and the kurtosis (Rkr), as described above are explained below with reference to the drawings.

The center-line mean roughness (Ra) is a surface roughness of the Fe-Ni alloy sheet, as expressed by the following formula:

$$Ra = \frac{1}{L}\int_{O}^{L} |f(x)|\,dx$$

where,

L: measuring length, and f(x): roughness curve.

The kurtosis (Rkr) is a sharpness index in the height direction of the roughness curve, as expressed by the following formula:

$$Rkr = \frac{1}{R_q^4}\int_{-\infty}^{\infty} Z^4 P(z)\,dz$$

where, $$Rq: \sqrt{\frac{1}{L}\int_{O}^{L} f(x)^2\,dx}$$

$$\int_{-\infty}^{\infty} Z^4 P(z)\,dz:$$

quarternary moment of the amplitude distribution curve.

Figure 2:
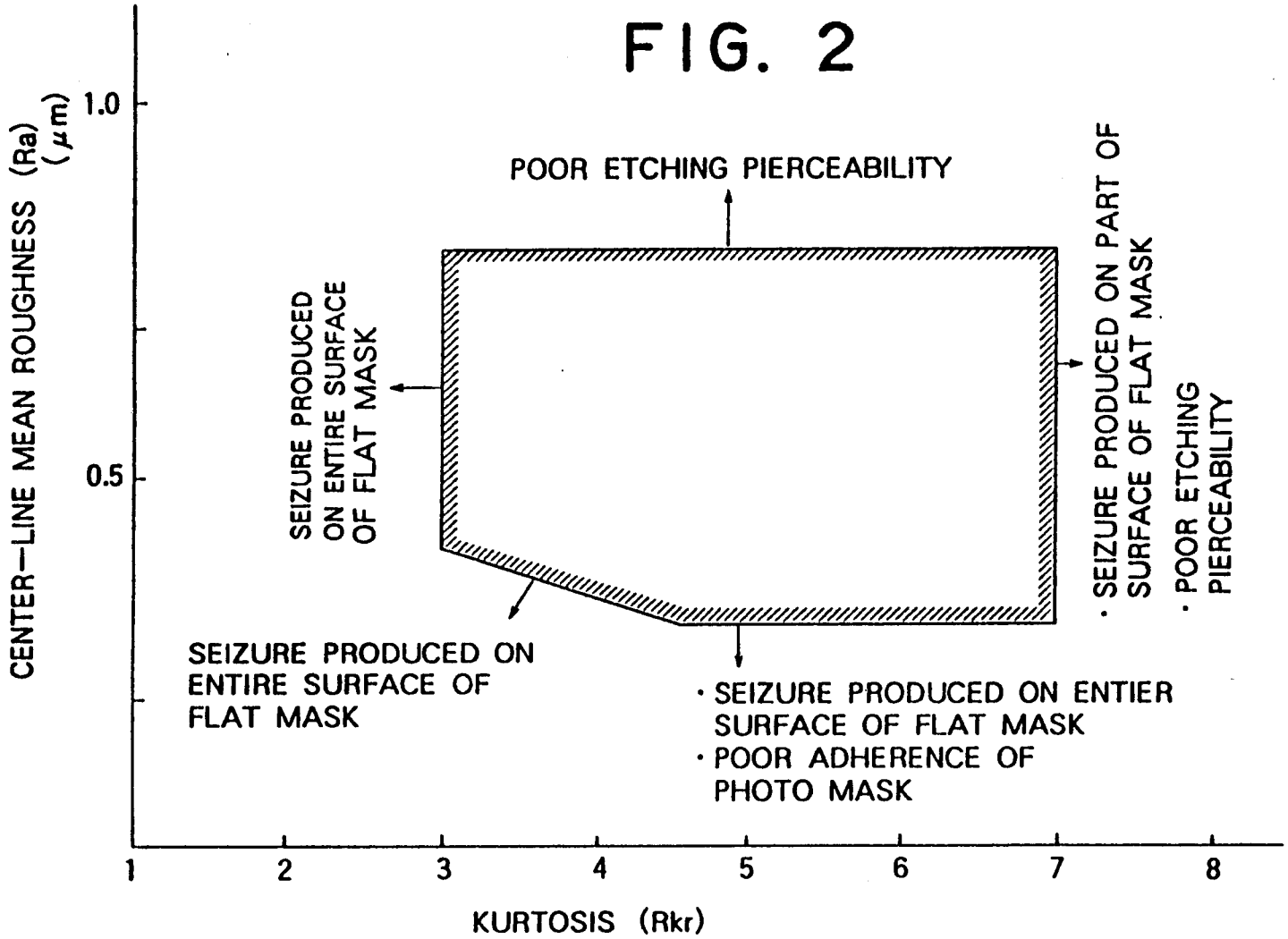
FIG. 2 is a graph illustrating the relationship between the center-line mean roughness (Ra) and the kurtosis (Rkr) of an Fe-Ni alloy sheet for a shadow mask, containing from 0.01 to 0.15 wt. % silicon and 0.0025 wt. % sulfur and having a silicon segregation rate of up to 10%, which relationship exerts an important effect on etching pierceability and seizure during the annealing of the flat mask made of the Fe-Ni alloy sheet.

FIG. 2 is a graph illustrating the relationship between the center-line mean roughness (Ra) and the kurtosis (Rkr) of an Fe-Ni alloy sheet for a shadow mask, containing from 0.01 to 0.15 wt. % silicon and 0.0025 wt. % sulfur and having a silicon segregation rate of up to 10%, which relationship exerts an important effect on etching pierceability and seizure during the annealing of the flat mask made of the Fe-Ni alloy sheet.

As is clear from FIG. 2, irrespective of the value of the kurtosis (Rkr), a value of the center-line mean roughness (Ra) of under 0.3 μm results in occurrence of seizure during the annealing of the flat mask over the entire surface thereof and in a poor adhesivity of a photo mask onto the surface of the flat mask during the etching-piercing. A value of the center-line mean roughness (Ra) of over 0.8 μm leads, on the other hand, to a lower etching pierceability of the flat mask. The value of the center-line mean roughness (Ra) should therefore satisfy the following formula (1):

$$0.3\ \mu m \leqq Ra \leqq 0.8\ \mu m \qquad (1)$$

Even with a value of the center-line mean roughness (Ra) within a range of from 0.3 to 0.8 μm, a value of the kurtosis (Rkr) of under 3 causes seizure during the annealing of the flat mask over the entire surface thereof. With a value of the kurtosis (Rkr) of over 7, on the other hand, seizure during the annealing of the flat mask occurs on part of the surface of the flat mask, and etching pierceability of the flat mask is deteriorated. The value of the kurtosis (Rkr) should therefore satisfy the following formula (2):

$$3 \leqq Rkr \leqq 7 \qquad (2)$$

When the center-line mean roughness (Ra) and the kurtosis (Rkr) satisfy the following formula, seizure occurs during the annealing of the flat mask over the entire surface thereof:

$$Ra < -\frac{1}{15}Rkr + 0.6$$

As is clear from FIG. 2, the lower limit value of the center-line mean roughness (Ra) at which seizure of the flat mask does not occur during the annealing thereof, within a range of the center-line mean roughness (Ra) of from 0.3 to 0.4 μm, can be lowered by increasing the value of the kurtosis (Rkr). This means that, since the occurrence of seizure of the flat mask can be prevented also by minimizing the value of the center-line mean roughness (Ra), it is possible to improve etching pierceability even when holes formed on the Fe-Ni alloy sheet are densified. The center-line mean roughness (Ra) and the kurtosis (Rkr) should therefore satisfy the following formula (3):

$$Ra \geqq -\frac{1}{15}Rkr + 0.5 \qquad (3)$$

It is thus possible to improve etching pierceability of the Fe-Ni alloy sheet for a shadow mask and prevent seizure of the flat mask made of the Fe-Ni alloy sheet during the annealing thereof, by limiting the values of the center-line mean roughness (Ra) and the kurtosis (Rkr) of the Fe-Ni alloy sheet, and limiting the relationship between the center-line mean roughness (Ra) and the kurtosis (Rkr), as described above. In order to further improve etching pierceability and more certainly prevent seizure of the flat mask during the annealing thereof, it is necessary to limit the value of an average peak interval (Sm), which is a parameter representing the surface roughness of the Fe-Ni alloy sheet, within an appropriate range.

The average peak interval (Sm) is a surface roughness of a sectional curve, as expressed by the following formula:

$$Sm = \frac{Sm_1 + Sm_2 + \ldots + Sm_n}{n}$$

where, $Sm_1$, $Sm_2$: peak interval, and n: number of peaks.

However, with a value of the average peak interval (Sm) of the Fe-Ni alloy sheet of under 70 μm, an excellent effect of preventing seizure of the flat mask is not available. With a value of the average peak interval (Sm) of over 160 μm, on the other hand, an excellent etching pierceability is not available. The value of the average peak interval (Sm) of the Fe-Ni alloy sheet should therefore satisfy the following formula (4):

$$70\ \mu m \leqq Sm \leqq 160\ \mu m \qquad (4)$$

It is thus possible to improve etching pierceability of the Fe-Ni alloy sheet for a shadow mask and prevent seizure of the flat mask made of the Fe-Ni alloy sheet during the annealing thereof, by limiting the values of the center-line mean roughness (Ra) and the kurtosis (Rkr) of the Fe-Ni alloy sheet, and limiting the relationship between the center-line mean roughness (Ra) and the kurtosis (Rkr), as described above. In order to reduce the production cost of the flat masks while preventing seizure of the flat mask even by increasing the number of flat masks piled up in a single run of the annealing, the values of the surface roughness in two directions of the Fe-Ni alloy sheet should satisfy the following formula (5):

$$\left.\begin{array}{l} |Ra(L) - Ra(C)| \leqq 0.1\ \mu m \\ |Rkr(L) - Rkr(C)| \leqq 0.5 \end{array}\right\} \quad (5)$$

where,

Ra(L): center-line mean roughness of the alloy sheet in the rolling direction,

Ra(C): center-line mean roughness of the alloy sheet in the crosswise direction to the rolling direction, Rkr(L): kurtosis of the alloy sheet in the rolling direction, and Rkr(C): kurtosis of the alloy sheet in the crosswise direction to the rolling direction.

It is thus possible to more certainly prevent seizure of the flat mask made of the Fe-Ni alloy sheet during the annealing thereof, by causing the average peak interval (Sm) of the Fe-Ni alloy sheet to satisfy the above-mentioned formula (4), and causing the center-line mean roughness (Ra) and the kurtosis (Rkr) in the two directions of the Fe-Ni alloy sheet to satisfy the above-mentioned formula (5). In order to further improve etching pierceability of the Fe-Ni alloy sheet, the average peak interval (Sm) in two directions of the Fe-Ni alloy sheet should satisfy the following formula (6), in addition to satisfying the above-mentioned formulae (4) and (5):

$$|Sm(L) - Sm(C)| \leqq 5.0\ \mu m \quad (6)$$

where,

Sm(L): average peak interval of the alloy sheet in the rolling direction, and

Sm(C): average peak interval of the alloy sheet in the crosswise direction to the rolling direction.

In order to increase the critical annealing temperature at which seizure of the flat mask made of the Fe-Ni alloy sheet for a shadow mask does not occur during the annealing of the flat mask, effective measures include optimalization of the average angle of inclination (Rθa) of the roughness curve of the Fe-Ni alloy sheet and reduction of the sulfur (S) content.

Figure 3:
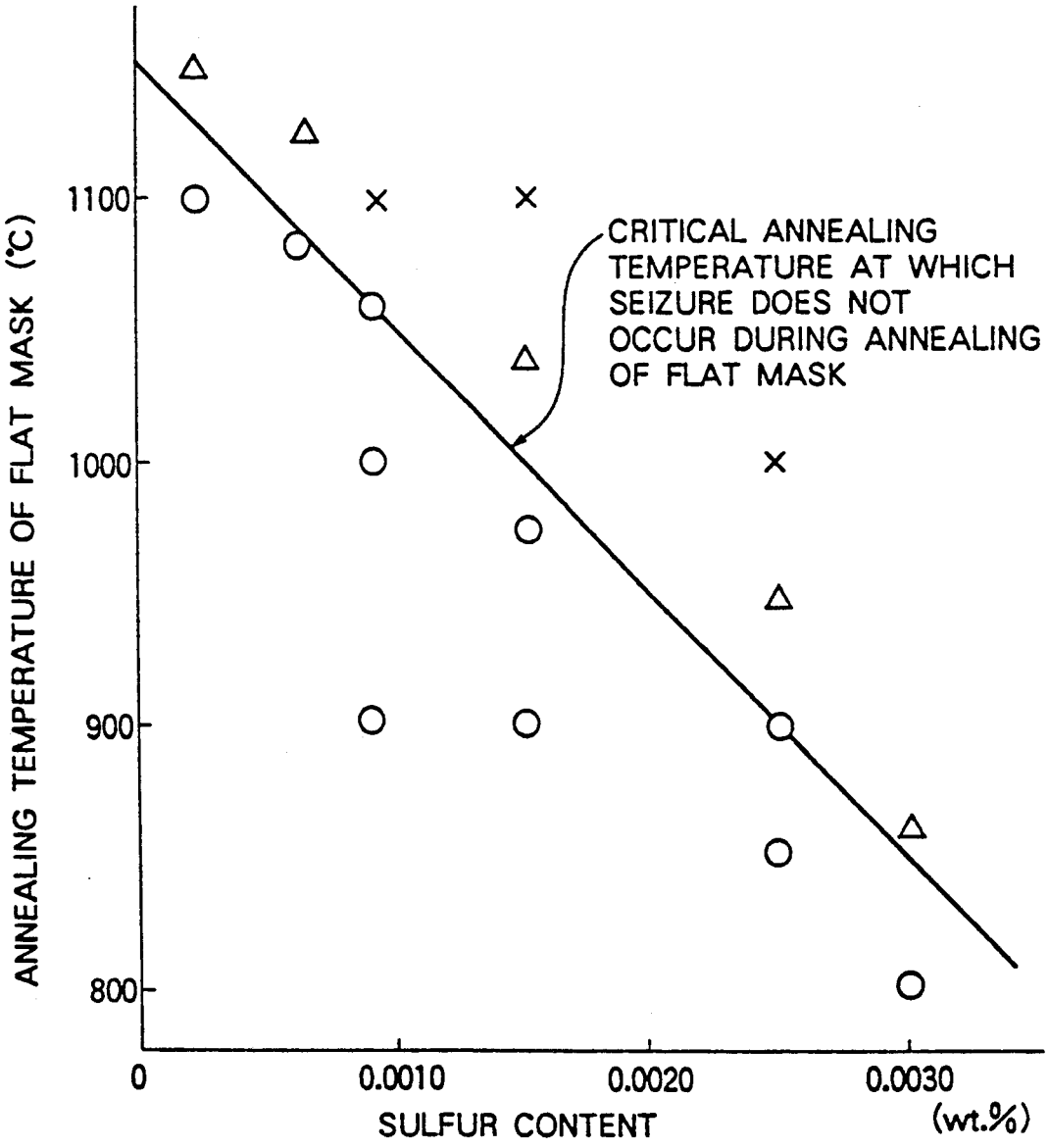
FIG. 3 is a graph illustrating the relationship between the sulfur content and the annealing temperature of an Fe-Ni alloy sheet for a shadow mask having a chemical composition, a silicon segregation rate, a center-line mean roughness (Ra), a kurtosis (Rkr) and an average angle of inclination ($R\theta a$) of the roughness curve, all within the scope of the present invention, which relationship exerts an important effect on seizure of a flat mask made of the Fe-Ni alloy sheet during annealing thereof.

FIG. 3 is graph illustrating the relationship between the sulfur content and the annealing temperature of an Fe-Ni alloy sheet for a shadow mask having a chemical composition, a silicon segregation rate, a center-line mean roughness (Ra), a kurtosis (Rkr) and an average angle of inclination (Rθa) of the roughness curve, all within the scope of the present invention, in the case where 30 flat masks made of the Fe-Ni alloy sheet are piled up and annealed, which relationship exerts an important effect on seizure of the flat mask during annealing thereof.

In FIG. 3, the mark "o" indicates non-occurrence of seizure of the flat mask; the mark "Δ" indicates occurrence of seizure on part of the surface of the flat mask; and the mark "x" indicates occurrence of seizure over the entire surface of the flat mask.

As is clear from FIG. 3, it is possible to increase the critical annealing temperature, at which seizure of the flat mask does not occur during annealing thereof, by reducing the sulfur content.

The mechanism of this effect brought about by the reduction of the sulfur content is not clearly known, but is conjectured to be attributable to the concurrence of the formation of a silicon oxide film on the surface of the flat mask and the precipitation of sulfur onto the surface of the flat mask during annealing of the flat mask, which formation of the silicon content and the precipitation of sulfur are effective for the prevention of seizure of the flat mask.

Figure 4:
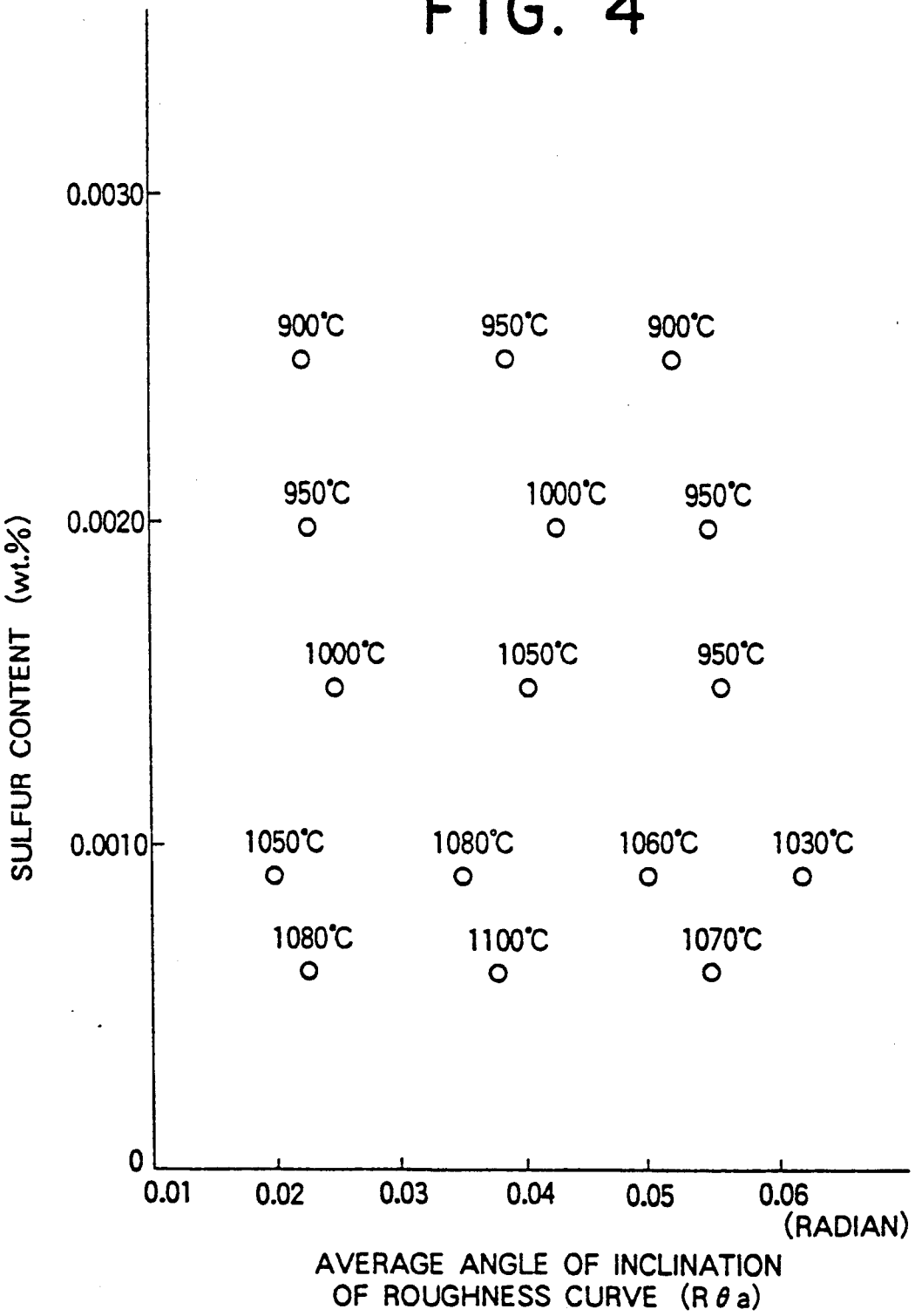
FIG. 4 is a graph illustrating the relationship between the sulfur content and the kurtosis (Rkr) of an Fe-Ni alloy sheet for a shadow mask, which relationship exerts an important effect on the critical annealing temperature of the Fe-Ni alloy sheet, at which seizure of the Fe-Ni alloy sheet does not occur during the annealing thereof.

It is possible to increase the critical annealing temperature, at which seizure of a flat mask made of the Fe-Ni alloy sheet does not occur during the annealing thereof, by reducing the sulfur content as described above. Even with the same sulfur content, it is possible to increase the critical annealing temperature, at which seizure of the flat mask does not occur during the annealing thereof, by maintaining the average angle of inclination (Rθa) of the roughness curve of the Fe-Ni alloy sheet within a specific range, as shown in FIG. 4. The average angle of inclination (Rθa) of the roughness curve should therefore satisfy the following formula (7):

$$0.03\ \text{radian} \leqq R\theta a \leqq 0.05\ \text{radian} \quad (7).$$

The Fe-Ni alloy sheet for a shadow mask of the present invention is manufactured by preparing a material sheet having the chemical composition and the silicon segregation rate described above, and imparting a prescribed surface roughness mentioned above to the both surfaces of the material sheet by mean of a pair of dull rolls during the final rolling, i.e., during the final cold rolling or the final temper rolling.

The above-mentioned dull roll can be obtained by imparting a prescribed surface roughness to a roll not as yet surface-worked by means of the electrospark working or the laser working, or more preferably, the shot blast method.

When the shot blast method is employed, it is desirable to use steel grits having a particle size within a range of from #120 (JIS symbol: G120) to #240 (JIS symbol: G240) and a hardness (Hv) within a range of from 400 to 950 as the shots and to set a relatively low shooting energy of the steel grits onto the roll surface for the #120 steel grits, and a relatively high shooting energy for the #240 steel grits.

A material roll for the dull roll should preferably be made of SKH (JIS symbol: G4403) and have a hardness (Hs) of from 85 to 95, a diameter of from 100 to 125 mm, and a center-line mean roughness of up to 0.1 μm. Under the above-mentioned conditions, a plurality of dull rolls are manufactured from the respective material rolls by the shot blast method. These plurality of dull rolls have different values of the surface roughness, these values of the surface roughness varying within the following ranges the center-line mean roughness (Ra) of from 0.4 to 1.5 μm, the kurtosis (Rkr) of from 3 to 12, and as required, the average peak interval (Sm) of from 40 to 200 μm.

The above-mentioned dull rolls are incorporated into a final cold rolling mill or a final temper rolling mill, and a prescribed surface roughness is imparted to the surface of the material sheet of the Fe-Ni alloy sheet. In order to accurately impart the prescribed surface roughness to the surface of the material sheet by means of the dull rolls, the sheet is passed through the dull rolls at least twice, with a reduction ratio of at least 10% per one pass.

When imparting the surface roughness to the material sheet by means of the dull rolls, a rolling oil having a viscosity within a range of from 7 to 8 CST at a temperature within a range of from 10° to 50° C. is used, and this rolling oil is supplied onto the surfaces of the dull rolls under a pressure within a range of from 0.1 to 0.5 kg/cm$^2$. The supply amount of the rolling oil is limited to the above-mentioned range because, with a supply amount of the rolling oil of under 0.1 kg/cm$^2$, a prescribed surface roughness is not imparted to the surface of the material sheet, and with a supply amount of the rolling oil of over 0.5 kg/cm$^2$, irregularities are caused in the surface roughness imparted to the material sheet.

Preferable rolling conditions by the dull rolls include a rolling speed within a range of from 30 to 200 m/minute, a tension of the material sheet within a range of from 15 to 45 kg/mm$^2$ on the downstream side of the dull rolls, a tension of the materials sheet within a range of from 10 to 40 kg/mm$^2$ on the upstream side of the dull rolls, and a reduction force per unit sheet width within a range of from 0.15 to 0.25 tons/mm. The tension of the material sheet during the rolling thereof by the dull rolls is set within the ranges as described above because this enables to increase flatness of the Fe-Ni alloy sheet for a shadow mask.

The prescribed surface roughness is imparted to the material sheet as described above. Prior to imparting the prescribed surface roughness to the material sheet, the material sheet may be subjected to an intermediate annealing to decrease hardness of the material sheet, or to a stress relieving annealing to remove a residual stress in the material sheet after imparting the prescribed surface roughness to the material sheet.

The above-mentioned intermediate annealing and stress relieving annealing are applied in a continuous annealing furnace for soft steel having a gaseous atmosphere with a hydrogen concentration of from 5 to 15% and a dew point of from −10° to −30° C., or in a bright annealing furnace having a gaseous atmosphere with a hydrogen concentration of from 15 to 100% and a dew point of from −20 to −60° C.

Now, the present invention is described further in detail by means of examples.

EXAMPLE 1

Ingots each weighing seven tons were prepared by the ladle refining, which comprised alloys A to E, respectively, each having the chemical composition as shown in Table 1 and containing non-metallic inclusions having the chemical composition as shown in Table 2.

TABLE 1

| | Chemical composition (wt. %) | | | | | | | | | |
|---|---|---|---|---|---|---|---|---|---|---|
| Alloy | Ni | Mn | Si | S | C | P | Cr | sol. Al | N | O |
| A | 35.7 | 0.28 | 0.05 | 0.0005 | 0.0019 | 0.002 | 0.02 | 0.007 | 0.0012 | 0.0010 |
| B | 35.5 | 0.29 | 0.08 | 0.0025 | 0.0015 | 0.002 | 0.05 | 0.008 | 0.0013 | 0.0014 |
| C | 35.8 | 0.30 | <0.01 | 0.0015 | 0.0020 | 0.002 | 0.03 | 0.006 | 0.0021 | 0.0021 |
| D | 35.9 | 0.40 | 0.18 | 0.0012 | 0.0025 | 0.002 | 0.03 | 0.008 | 0.0015 | 0.0028 |
| E | 36.0 | 0.29 | 0.02 | 0.0006 | 0.0037 | 0.003 | 0.01 | 0.010 | 0.0009 | 0.0011 |

TABLE 2

| | Chemical composition of non-metallic inclusions (wt. %) | | | Distribution of non-metallic inclusions (number/mm$^2$) | | | | | |
|---|---|---|---|---|---|---|---|---|---|
| | | | | Thickness of spherical inclusions in sheet thickness direction (μm) | | | | Thickness of linear inclusions in sheet thickness direction (μm) | |
| Alloy | CaO | $Al_2O_3$ | MgO | Under 3 | 3~6 | 6~14 | Over 14 | Under 3 | 3~5 |
| A | 55 | 5 | 40 | 7 | 0 | 0 | 0 | 0 | 0 |
| B | 15 | 60 | 25 | 13 | 1 | 0 | 0 | 0 | 0 |
| C | 10 | 0 | 90 | 14 | 0 | 0 | 0 | 0 | 0 |
| D | 25 | 5 | 70 | 16 | 0 | 0 | 0 | 0 | 0 |
| E | 40 | 35 | 25 | 10 | 0 | 0 | 0 | 0 | 0 |

Figure 5:
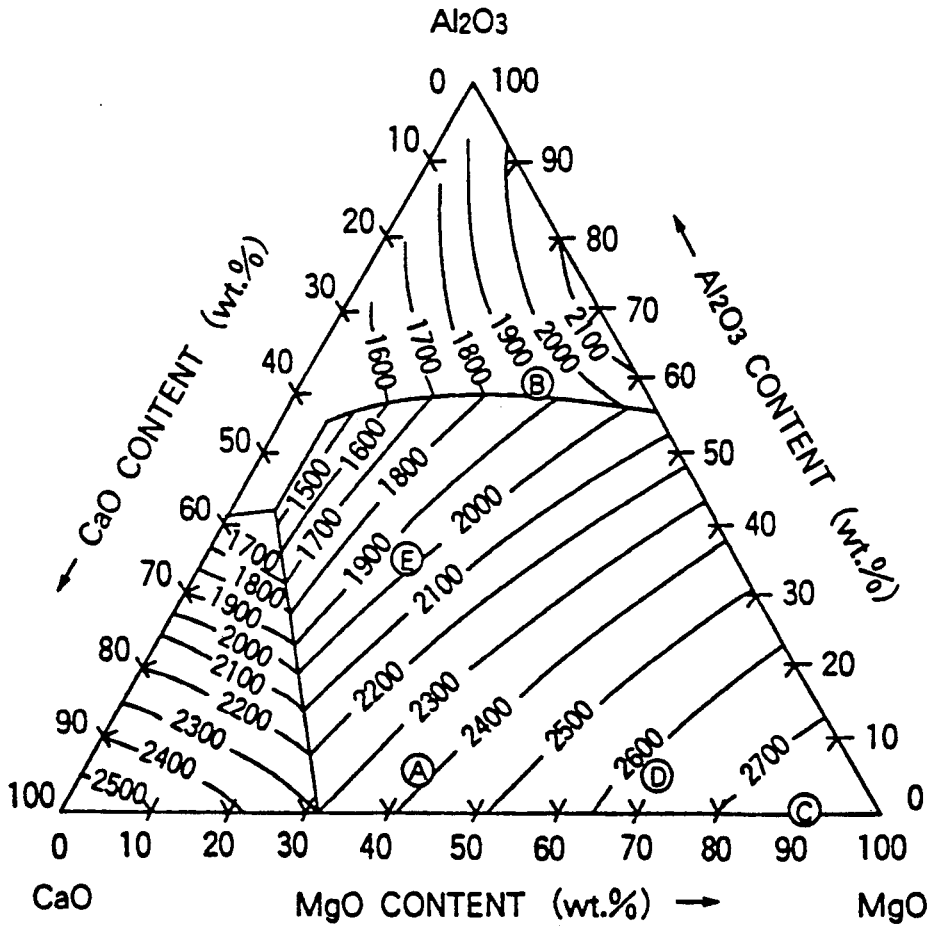
FIG. 5 is the $CaO$-$Al_2O_3$-$MgO$ ternary phase diagram illustrating the chemical composition of non-metallic inclusions contained in each of the alloys A to E used in the Examples of the present invention.

FIG. 5 is the CaO-$Al_2O_3$-MgO ternary phase diagram illustrating the chemical compositions of non-metallic inclusions contained in each of the alloys A to E.

The ladle used in the ladle refining of the above-mentioned ingots comprised an MgO—CaO refractory containing up to 40 wt. % CaO, and the molten slag used was a CaO-$Al_2O_3$-MgO slag having a ratio of (CaO)/{(CaO)+($Al_2O_3$)} of at least 0.45, and containing up to 25 wt. % MgO, up to 15 wt. % $SiO_2$, and up to 3 wt. % oxide of a metal having an oxygen affinity lower than that of silicon.

Then, each of the thus prepared ingots was acarfed, heated at a temperature of 1,200° C. for 20 hours, and subjected to a primary slabbing at a sectional reduction rate of 60% to prepare a slab. Then, each of the thus prepared slabs was heated at a temperature of 1,200° C. for 20 hours, subjected to a secondary slabbing at a sectional reduction rate of 45%, and slowly cooled to prepare a finished slab. From each of the thus prepared finished slabs comprising the alloys A to E, Fe-Ni alloy sheets for a shadow mask Nos. 1 to 10 as shown in Table 3 were manufactured, respectively, in accordance with a method described later: The alloy sheets Nos. 1 to 6 were manufactured from the slab comprising the alloy A; the alloy sheet No. 7 was manufactured from the slab comprising the alloy B; the alloy sheet No. 8 was manufactured from the slab comprising the alloy C; the alloy sheet No. 9 was manufactured from the slab comprising the alloy D; and the alloy sheet No. 10 was manufactured from the slab comprising the alloy E.

The finished slab comprising the alloy A, from which the alloy sheet No. 2 was manufactured was prepared, unlike the above-mentioned preparation of the finished slabs A to D, by heating the ingot at a temperature of 1,200° C. for 15 hours, subjecting the ingot to a primary slabbing at a sectional reduction rate of 78%, and slow cooling.

The manufacturing method of the above-mentioned alloy sheets Nos. 1 to 10 is described further in detail below. First, each of the slabs was scarfed, and an anti-oxidation agent was applied onto the surface of the slab. Then, the slab was heated to a temperature of 1,100° C. and hot-rolled to prepare a hot coil under the hot-rolling conditions including a total reduction ratio at a temperature of at least 1,000° C. of 82%, a total reduction ratio at a temperature of at least 850° C. of 98%, and a coiling temperature of the hot coil of from 550° to 750° C.

Each of the thus prepared hot coils was descaled, and subjected to repeated cycles of a cold rolling and an annealing to prepare a material sheet for the Fe-Ni alloy sheet for a shadow mask. Then, upon the final temper rolling, a surface roughness as shown in Table 3 was imparted by means of the dull rolls described later, which were incorporated in the temper rolling mill, to the both surfaces of the material sheet, thereby manufacturing each of the Fe-Ni alloy sheets Nos. 1 to 10 for a shadow mask having a thickness of 0.25 mm.

The distribution of non-metallic inclusions contained in each of the thus manufactured alloy sheets for a shadow mask Nos. 1 to 10 is shown in Table 2 for each of the alloys A to E, together with the chemical composition of the non-metallic inclusions.

As is clear from Table 2, non-metallic inclusions contained in each of the alloys A to E had a melting point of at least 1,600° C., and mainly comprised spherical inclusions having a thickness of up to 3 μm. This inhibited the formation of pits on the hole surface caused by non-metallic inclusions during the etching-piercing of the Fe-Ni alloy sheet, and almost minimized the problem of contamination of the etching solution caused by the entanglement of linear inclusions into the etching solution.

The above-mentioned distribution of the non-metallic inclusions was evaluated by the following method: Enlarging the section of the alloy sheet along the rolling direction to 800 magnifications through a microscope, and measuring a thickness in the sheet thickness direction and a length in the rolling direction of all non-metallic inclusions within the field of vision. The measured sections had a total area of 60 $mm^2$. The values of thickness of the spherical inclusions and the linear inclusions in the sheet thickness direction were classified by size to evaluate the above-mentioned distribution in terms of the number of inclusions per $mm^2$.

The spherical inclusions are those having a ratio of length to thickness of inclusions of up to 3, i.e., (length/thickness)$\leqq 3$, and the linear inclusions are those having a ratio of length to thickness of inclusions of over 3, i.e., (length/thickness)$>3$.

The dull roll was manufactured as follows: Steel grits having a particle size of #120 (JIS symbol: G120) and a hardness (Hv) of from 400 to 950 were shot by the shot blast method onto the surfaces of a material roll with a smooth surface made of SKH (JIS symbol: G4403) and having a hardness (Hs) of 90 and a diameter of 120 mm, thereby manufacturing, from the respective material rolls, a plurality of dull rolls having a surface roughness including a center-line mean roughness (Ra) of from 0.30 to 1.20 μm and a kurtosis (Rkr) of from 3 to 12.

For rolling of the Fe-Ni alloy sheet by means of the above-mentioned dull rolls, the reduction ratio for the first pass of the alloy sheet was set at 18.6%, the reduction ratio for the second pass, at 12.3%, and the total reduction ratio, at 28.6%. A rolling oil having a viscosity of 7.5 CST was employed with a supply amount of rolling oil of 0.4 $kg/cm^2$. The other rolling conditions included a rolling speed of 100 m/minute, a tension of the alloy sheet of 20 $kg/mm^2$ on the downstream side of the dull rolls, a tension of the alloy sheet of 15 $kg/mm^2$ on the upstream side of the dull rolls, and a reduction force per unit sheet width of 0.20 tons/mm.

The silicon segregation rate in the surface portion of the Fe-Ni alloy sheets was investigated by means of a mapping analyzer based on the EPMA (abbreviation of Electron Probe Micro Analyzer).

A flat mask was manufactured by forming holes etching-piercing on each of the alloy sheets Nos. 1 to 10 through the etching-piercing to investigate etching pierceability, and the surfaces of the holes formed by the etching-piercing were observed by means of a scanning type electron microscope to investigate the presence of pits on the hole surfaces. Contamination of the etching solution was evaluated from the amount of residual slag in the etching solution after the etching-piercing. Then, 30 flat masks were piled up and annealed at a temperature of 900° C. to investigate the occurrence of seizure of the flat masks. The results are shown in Table 3.

TABLE 3

| | | | Surface roughness | | | | | |
|---|---|---|---|---|---|---|---|---|
| Alloy | Alloy sheet No. | Si Segregation rate (%) | Ra(L) (μm) | Ra(C) (μm) | Rkr(L) | Rkr(C) | \|Ra(L) − Ra(C)\| (μm) | \|Rkr(L) − Rkr(C)\| |
| A | 1 | 4 | 0.55 | 0.60 | 4.3 | 4.2 | 0.05 | 0.1 |
| | 2 | 16 | 0.65 | 0.75 | 5.0 | 5.3 | 0.10 | 0.3 |
| | 3 | 7 | 0.90 | 0.85 | 3.5 | 3.8 | 0.05 | 0.3 |
| | 4 | 5 | 0.35 | 0.40 | 3.5 | 4.0 | 0.05 | 0.5 |
| | 5 | 5 | 0.65 | 0.70 | 2.8 | 2.5 | 0.05 | 0.3 |
| | 6 | 6 | 0.50 | 0.60 | 7.5 | 7.2 | 0.10 | 0.3 |
| B | 7 | 7 | 0.70 | 0.65 | 4.0 | 3.6 | 0.05 | 0.4 |
| C | 8 | 2 | 0.60 | 0.65 | 3.4 | 3.0 | 0.05 | 0.4 |
| D | 9 | 9 | 0.55 | 0.65 | 5.0 | 4.7 | 0.10 | 0.3 |
| E | 10 | 2 | 0.60 | 0.55 | 6.0 | 6.5 | 0.05 | 0.5 |

| | Surface roughness | | | Seizure | | |
|---|---|---|---|---|---|---|
| | (Ra) + 1/15 (Rkr) − 0.6 | Rθa (radian) | Etching pierceability | during annealing | Pits on hole surface | Etching solution contamination |

TABLE 3-continued

| | | | | | | |
|---|---|---|---|---|---|---|
| A | Positive | 0.042 | ○ | ○ | None | Very slight |
| | Positive | 0.041 | Δ | Δ | | |
| | Positive | 0.034 | X | ○ | | |
| | Negative | 0.035 | ○ | X | | |
| | Positive | 0.037 | ○ | X | | |
| | Positive | 0.037 | Δ | Δ | | |
| B | Positive | 0.045 | ○ | ○ | None | Very slight |
| C | Positive | 0.040 | ○ | X | None | Very slight |
| D | Positive | 0.032 | X | ○ | None | Very slight |
| E | Positive | 0.040 | ○ | ○ | None | Very slight |

In Table 3, the evaluation of the center-line mean roughness (Ra) was based on whether or not both Ra(L) and Ra(C) satisfied the scope of the present invention. This was also the case with the evaluation of the kurtosis (Rkr) and the average peak interval (Sm) described later. In these columns of Table 3, (L) represents measured values in the rolling direction, and (C) represents measured values in the crosswise direction to the rolling direction. When calculating "(Ra)+1/5(Rkr)−0.6", the measured values in the above-mentioned (L) and those in the above-mentioned (C), whichever the smaller were adopted as the values of the center-line mean roughness (Ra) and the kurtosis (Rkr). This applied also for all the other examples presented hereafter.

In the column "Etching pierceability" in Table 3, the mark "◎" represents the case where the diameter and the shape of the hole formed by the etching-piercing are perfectly free from irregularities and etching pierceability is very excellent; the mark "○" represents the case where the diameter and the shape of the hole formed by the etching-piercing show slight irregularities, with however no practical difficulty, and etching pierceability is excellent; the mark "Δ" represents the case where irregularities are produced in the hole diameter and the hole shape; and the mark "x" represents the case where serious irregularities are produced in the hole diameter and the hole shape. This evaluation applies also for all the other examples presented hereafter.

In the column "Seizure during annealing" of the flat mask in Table 3, the mark "○" represents non-occurrence of seizure of the flat mask; the mark "Δ" represents the occurrence of seizure of the flat mask on part of surface thereof; and the mark "x" represents the occurrence of seizure of the flat mask over the entire surface thereof. This evaluation applies also for all the other examples presented hereafter.

As is clear from Table 3, the alloy sheets Nos. 1, 7 and 10 have a silicon content, a silicon segregation rate, and a surface roughness, all within the scope of the present invention.

These alloy sheets Nos. 1, 7 and 10 are therefore excellent in etching pierceability and no seizure of the flat mask is produced during the annealing thereof.

In the alloy sheets Nos. 2, 8 and 9, in contrast, although the surface roughness is within the scope of the present invention, the silicon segregation rate is large outside the scope of the present invention for the alloy sheet No. 2; the silicon content is small outside the scope of the present invention for the alloy sheet No. 8; and the silicon content is large outside the scope of the present invention for the alloy sheet No. 9.

The alloy sheet No. 2 has therefore a slightly poor etching pierceability, with occurrence of seizure of the flat mask on part of the surface thereof; the alloy sheet No. 8, while being excellent in etching pierceability, suffers from seizure of the flat mask over the entire surface thereof; and the alloy sheet No. 9 has a low etching pierceability, with no occurrence of seizure of the flat mask.

In the alloy sheets Nos. 3, 4, 5 and 6, although the silicon content and the silicon segregation rate are all within the scope of the present invention, the center-line mean roughness (Ra) is large outside the scope of the present invention for the alloy sheet No. 3; the value of "(Ra)+1/15(Rkr)−0.6" is outside the scope of the present invention for the alloy sheet No. 4; the kurtosis (Rkr) is small outside the scope of the present invention for the alloy sheet No. 5; and the kurtosis (Rkr) is large outside the scope of the present invention for the alloy sheet No. 6.

The alloy sheet No. 3 is therefore has a low etching pierceability, with no occurrence of seizure of the flat mask; the alloy sheets Nos. 4 and 5, while being excellent in etching pierceability, suffer from seizure of the flat mask over the entire surface thereof; and the alloy sheet No. 6 has a slightly poor etching pierceability, with occurrence of seizure of the flat mask on part of the surface thereof.

These observations suggest that, in order to obtain an Fe-Ni alloy sheet for a shadow mask, which is excellent in etching pierceability and free from seizure of the flat mask during the annealing thereof, it is necessary to limit the silicon content, the silicon segregation rate, the center-line mean roughness (Ra), the kurtosis (Rkr), and the value of "(Ra)+1/15(Rkr)−0.6" within the scope of the present invention.

EXAMPLE 2

A material sheet for the Fe-Ni alloy sheet for a shadow mask was prepared by repeating a cycle comprising a cold rolling and an annealing in the same manner as in Example 1 with the use of the respective hot coil from which the alloy sheets Nos. 1, 7 and 10 were prepared in Example 1. Then, upon the final temper rolling, a surface roughness as shown in Table 4 was imparted to the both surfaces of the thus prepared material sheet by means of the dull rolls described later, which were incorporated in the temper rolling mill, thereby manufacturing each of the Fe-Ni alloy sheets Nos. 11 to 22 for a shadow mask having a thickness of 0.25 mm. More specifically, the alloy sheets Nos. 11 to 15 were manufactured from the hot coil for the alloy sheet No. 1; the alloy sheets Nos. 16 to 21 were manufactured from the hot coil for the alloy sheet No. 7; and the alloy sheet No. 22 was manufactured from the hot coil for the alloy sheet No. 10.

The dull rolls had different values of surface roughness from each other, which included a center-line mean roughness (Ra) of from 0.45 to 1.00 μm and a kurtosis (Rkr) of from 3 to 12.

The manufacturing conditions of the dull rolls and the rolling conditions of the material sheet for the Fe-Ni alloy sheet by the dull rolls were the same as those in Example 1.

Investigation of the silicon segregation rate for each of the alloy sheets Nos. 11 to 22, which was carried out in the same manner as in Example 1, revealed that the silicon segregation rate was within a range of from 4 to 7% in all cases. Then, a flat mask was manufactured by forming holes on each of the alloy sheets Nos. 11 to 22 through the etching-piercing to investigate etching pierceability in the same manner as in Example 1. Then, 50 flat masks were piled up and annealed at a temperature shown in Table 4 to investigate the occurrence of seizure of the flat masks during the annealing thereof. The results are shown in Table 4.

TABLE 4

| Alloy | Alloy sheet No. | Si Segregation rate (%) | Surface roughness Ra(L) (μm) | Ra(C) (μm) | Rkr(L) | Rkr(C) | \|Ra(L) − Ra(C)\| (μm) | \|Rkr(L) − Rkr(C)\| |
|---|---|---|---|---|---|---|---|---|
| A | 11 | 4 | 0.55 | 0.60 | 4.3 | 4.2 | 0.05 | 0.1 |
| | 12 | 6 | 0.55 | 0.75 | 3.8 | 4.2 | 0.20 | 0.4 |
| | 13 | 7 | 0.60 | 0.70 | 5.0 | 5.6 | 0.10 | 0.6 |
| | 14 | 7 | 0.45 | 0.65 | 4.1 | 5.0 | 0.20 | 0.9 |
| | 15 | 7 | 0.45 | 0.65 | 4.1 | 5.0 | 0.20 | 0.9 |
| B | 16 | 4 | 0.65 | 0.60 | 3.7 | 3.5 | 0.05 | 0.2 |
| | 17 | 4 | 0.65 | 0.60 | 3.7 | 3.5 | 0.05 | 0.2 |
| | 18 | 4 | 0.55 | 0.55 | 3.8 | 4.0 | 0.00 | 0.2 |
| | 19 | 4 | 0.55 | 0.55 | 3.8 | 4.0 | 0.00 | 0.2 |
| | 20 | 4 | 0.70 | 0.65 | 4.0 | 3.6 | 0.05 | 0.1 |
| | 21 | 4 | 0.70 | 0.65 | 4.0 | 3.6 | 0.05 | 0.1 |
| E | 22 | 2 | 0.65 | 0.60 | 6.0 | 6.2 | 0.05 | 0.2 |

| | Surface roughness (Ra) + 1/15 (Rkr) − 0.6 | Rθa (radian) | Etching pierceability | Seizure during annealing | Annealing temperature (°C.) |
|---|---|---|---|---|---|
| A | Positive | 0.042 | ○ | ○ | 950 |
| | Positive | 0.037 | ○ | Δ | 950 |
| | Positive | 0.048 | ○ | Δ | 950 |
| | Positive | 0.039 | ○ | Δ | 950 |
| | Positive | 0.039 | ○ | ○ | 900 |
| B | Positive | 0.025 | ○ | ○ | 850 |
| | Positive | 0.025 | ○ | Δ | 900 |
| | Positive | 0.054 | ○ | ○ | 850 |
| | Positive | 0.054 | ○ | Δ | 900 |
| | Positive | 0.045 | ○ | ○ | 900 |
| | Positive | 0.045 | ○ | Δ | 950 |
| E | Positive | 0.039 | ○ | ○ | 950 |

As is clear from Table 4, the alloy sheets Nos. 11 and 22, have a silicon content, a silicon segregation rate and a surface roughness all within the scope of the present invention. In addition, the alloy sheet No. 11 has a sulfur content of 0.0005 wt. % and the alloy sheet No. 22 has a sulfur content of 0.0006 wt. %.

These alloy sheets Nos. 11 and 22 are therefore excellent in etching pierceability, with no occurrence of seizure of the flat mask even at an annealing temperature of 950° C.

The alloy sheet No. 21 has in contrast a silicon content, a silicon segregation rate and a surface roughness all within the scope of the present invention, but has a sulfur content of 0.0025 wt. % larger than in the alloy sheets Nos. 11 and 22. The alloy sheet No. 21 is therefore excellent in etching pierceability with however the occurrence of seizure of the flat mask on part of the surface thereof at an annealing temperature of 950° C.

This suggests that, even when the silicon content, the silicon segregation rate and the surface roughness are within the scope of the present invention, if a high annealing temperature of the flat mask is maintained, seizure of the flat mask can be prevented by reducing the sulfur content.

The alloy sheet No. 15, while having the center-line mean roughness (Ra) and the kurtosis (Rkr) in two directions are large outside the scope of the present invention, with the other conditions within the scope of the present invention, is excellent in etching pierceability, and shows no occurrence of seizure of the flat mask at an annealing temperature of 900° C.

The alloy sheet No. 14, in contrast, having a center-line mean roughness (Ra) and a kurtosis (Rkr) in two directions similar to those of the alloy sheet No. 15, is excellent in etching pierceability with however the occurrence of seizure of the flat mask on part of the surface thereof at an annealing temperature of 950° C., which is higher than that in the alloy sheet No. 15.

The alloy sheet No. 12, in which the values of center-line mean roughness (Ra) in two directions are large outside the scope of the present invention, but all the other conditions are within the scope of the present invention, is excellent in etching pierceability with however the occurrence of seizure of the flat mask on part of the surface thereof because of the high annealing temperature of 950° C.

The alloy sheet No. 13, in which the values of kurtosis (Rkr) in two directions are large outside the scope of the present invention, but all the other conditions are within the scope of the present invention, is excellent in etching pierceability with however the occurrence of seizure of the flat mask on part of the surface thereof because of the high annealing temperature of 950° C., as in the alloy sheet No. 12.

Therefore, when annealing the flat masks at a high temperature, it is necessary to limit the centerline mean roughness (Ra) and the kurtosis (Rkr) in two directions within the scope of the present invention.

In the alloy sheets Nos. 16 and 17, the average angle of inclination (Rθa) of the roughness curve is small outside the scope of the present invention, but the other conditions are within the scope of the present invention. The alloy sheet No. 16, annealed at an annealing temperature of 850° C., shows no seizure of the flat mask. The alloy sheet No. 17, on the other hand, annealed at an annealing temperature of 900° C., shows seizure of the flat mask on part of the surface thereof.

In the alloy sheets Nos. 18 and 19, the average angle of inclination (Rθa) of the roughness curve is large outside the scope of the present invention, but the other conditions are within the scope of the present invention. The alloy sheet No. 18, annealed at an annealing temperature of 850° C., shows no seizure of the flat mask. The alloy sheet No. 19, on the other hand, annealed at an annealing temperature of 900° C., shows seizure of the flat mask on part of the surface thereof.

The alloy sheet No. 20, in which all the conditions including the average angle of inclination (Rθa) of the roughness curve are within the scope of the present invention, shows no seizure of the flat mask even at an annealing temperature of 900° C.

Even with the same sulfur content, it is thus possible to increase the critical annealing temperature at which seizure of the flat mask does not occur by maintaining the average angle of inclination (Rθa) of the roughness curve with in the scope of the present invention.

EXAMPLE 3

A material sheet for the Fe-Ni alloy sheet for a shadow mask was prepared by repeating a cycle comprising a cold rolling and an annealing in the same manner as in Example 1 with the use of the respective hot coil from which the alloy sheets Nos. 1, 2 and 7 to 10 were prepared in Example 1. Then, upon the final temper rolling, a surface roughness as shown in Table 5 was imparted to the both surfaces of the thus prepared material sheet by means of the dull rolls described later, which were incorporated in the temper rolling mill, thereby manufacturing each of the Fe-Ni alloy sheets Nos. 23 to 35 for a shadow mask having a thickness of 0.25 mm. More specifically, the alloy sheets Nos. 23 and 25 to 31 were manufactured from the hot coil for the alloy sheet No. 1; the alloy sheet No. 24 was manufactured from the hot coil for the alloy sheet No. 2; the alloy sheet No. 32 was manufactured from the hot coil for the alloy sheet No. 7; the alloy sheet No. 33 was manufactured from the hot coil for the alloy sheet No. 8; the alloy sheet No. 34 was manufactured from the hot coil for the alloy sheet No. 9; and the alloy sheet No. 35 was manufactured from the hot coil for the alloy sheet No. 10.

The dull rolls had different values of surface roughness from each other, which included a center-line mean roughness (Ra) of from 0.30 to 1.20 μm, a kurtosis (Rkr) of from 3 to 12, and an average peak interval (Sm) of from 30 to 210 μm of the sectional curve.

The manufacturing conditions of the dull rolls and the rolling conditions of the material sheet for the Fe-Ni alloy sheet by the dull rolls were the same as those in Example 1.

The silicon segregation rate of each of the alloy sheets Nos. 23 to 35 was investigated in the same manner as in Example 1. Then, a flat mask was manufactured by forming holes on each of the alloy sheets Nos. 23 to 35 through the etching-piercing to investigate etching pierceability in the same manner as in Example 1. Then, 30 flat masks were piled up and annealed at a temperature of 900° C. to investigate the occurrence of seizure of the flat masks during the annealing thereof. The results are shown in Table 5.

TABLE 5

| | | | Surface roughness | | | | | |
|---|---|---|---|---|---|---|---|---|
| Alloy | Alloy Sheet No. | Si Segregation rate (%) | Ra(L) (μm) | Ra(C) (μm) | Rkr(L) | Rkr(C) | \|Ra(L) − Ra(C)\| (μm) | \|Rkr(L) − Rkr(C)\| |
| A | 23 | 4 | 0.55 | 0.60 | 4.3 | 4.2 | 0.05 | 0.1 |
| | 24 | 16 | 0.65 | 0.75 | 5.0 | 5.3 | 0.10 | 0.3 |
| | 25 | 7 | 0.90 | 0.85 | 3.5 | 3.8 | 0.05 | 0.3 |
| | 26 | 5 | 0.35 | 0.40 | 3.5 | 4.0 | 0.05 | 0.5 |
| | 27 | 5 | 0.65 | 0.70 | 2.8 | 2.5 | 0.05 | 0.3 |
| | 28 | 6 | 0.50 | 0.60 | 7.5 | 7.2 | 0.10 | 0.3 |
| | 29 | 4 | 0.50 | 0.55 | 5.1 | 5.4 | 0.05 | 0.3 |
| | 30 | 4 | 0.65 | 0.70 | 6.3 | 6.2 | 0.05 | 0.1 |
| | 31 | 4 | 0.60 | 0.65 | 4.5 | 4.1 | 0.05 | 0.4 |
| B | 32 | 7 | 0.70 | 0.65 | 4.0 | 3.6 | 0.05 | 0.4 |
| C | 33 | 2 | 0.60 | 0.65 | 3.4 | 3.0 | 0.05 | 0.4 |
| D | 34 | 9 | 0.55 | 0.65 | 5.0 | 4.7 | 0.10 | 0.3 |
| E | 35 | 2 | 0.65 | 0.60 | 6.5 | 6.3 | 0.05 | 0.2 |

| | Surface roughness | | | | | | |
|---|---|---|---|---|---|---|---|
| | (Ra) + 1/15 (Rkr) − 0.6 | Sm(L) (μm) | Sm(C) (μm) | \|Sm(L) − Sm(C)\| (μm) | Rθa (radian) | Etching pierceability | Seizure during annealing |
| A | Positive | 106 | 113 | 7 | 0.042 | ○ | ○ |
| | Positive | 81 | 82 | 1 | 0.041 | Δ | Δ |
| | Positive | 155 | 152 | 3 | 0.034 | X | ○ |
| | Negative | 101 | 98 | 3 | 0.035 | ◎ | X |
| | Positive | 135 | 130 | 5 | 0.037 | ◎ | X |
| | Positive | 120 | 116 | 4 | 0.037 | Δ | Δ |
| | Positive | 176 | 173 | 3 | 0.042 | Δ | ○ |
| | Positive | 61 | 56 | 5 | 0.048 | ○ | Δ |
| | Positive | 105 | 104 | 1 | 0.045 | ◎ | ○ |
| B | Positive | 111 | 110 | 1 | 0.045 | ◎ | ○ |
| C | Positive | 82 | 86 | 4 | 0.040 | ◎ | X |
| D | Positive | 143 | 147 | 4 | 0.032 | X | ○ |
| E | Positive | 120 | 121 | 1 | 0.040 | ◎ | ○ |

As is clear from Table 5, the alloy sheets Nos. 23, 31, 32 and 35 have a silicon content, a silicon segregation rate, and a surface roughness all within the scope of the present invention.

These alloy sheets Nos. 23, 31, 32 and 35 are therefore excellent in etching pierceability, and have no seizure of the flat mask during the annealing thereof. The alloy sheets Nos. 31, 32 and 35, which have the values of average peak interval in two directions within the scope of the present invention, are particularly excellent in etching pierceability.

The alloy sheets Nos. 24, 33 and 34, in contrast, have a surface roughness within the scope of the present invention. However, the alloy sheet No. 24 has a large silicon segregation rate outside the scope of the present invention; the alloy sheet No. 33 has a small silicon content outside the scope of the present invention; and the alloy sheet No. 34 has a large silicon content outside the scope of the present invention.

Therefore, the alloy sheet No. 24 is slightly poor in etching pierceability with the occurrence of seizure of the flat mask on part of the surface thereof; the alloy sheet No. 33, while being very excellent in etching pierceability, suffers from the occurrence of seizure of the flat mask over the entire surface thereof; and the alloy sheet No. 34 has a very poor etching pierceability, with however no occurrence of seizure of the flat mask.

The alloy sheets Nos. 25 to 28 have a silicon content and a silicon segregation rate within the scope of the present invention. However, the alloy sheet No. 25 has a large center-line mean roughness (Ra) outside the scope of the present invention; the alloy sheet No. 26 has a value of "(Ra)+1/15(Rkr)−0.6" outside the scope of the present invention; the alloy sheet No. 27 has a small kurtosis (Rkr) outside the scope of the present invention; and the alloy sheet No. 28 has a large kurtosis (Rkr) outside the scope of the present invention.

Therefore, the alloy sheet No. 25 has a low etching pierceability with no occurrence of seizure of the flat mask; the alloy sheets Nos. 26 and 27, while being very excellent in etching pierceability, suffer from occurrence of seizure of the flat mask over the entire surface thereof; and the alloy sheet No. 28 has a slightly poor etching pierceability with the occurrence of seizure of the flat mask on part of the surface thereof.

The alloy sheet No. 29, in which the values of surface roughness are within the scope of the present invention but the average peak interval (Sm) of the sectional curve is large outside the scope of the present invention, while showing no seizure of the flat mask, is slightly poor in etching pierceability. The alloy sheet No. 30, in which the values of surface roughness are within the scope of the present invention but the average peak interval (Sm) of the sectional curve is small outside the scope of the present invention, while being excellent in etching pierceability, shows seizure of the flat mask on part of the surface thereof.

These observations suggest that, in order to obtain an Fe-Ni alloy sheet for a shadow mask, which is very excellent in etching pierceability and free from seizure of the flat mask during the annealing thereof, it is necessary to limit the silicon content, the silicon segregation rate, the center-line mean roughness (Ra), the kurtosis (Rkr), the value of "(Ra)+1/15 (Rkr)−0.6", and the values of average peak intervals (Sm) in two directions within the scope of the present invention.

EXAMPLE 4

A material sheet for the Fe-Ni alloy sheet for a shadow mask was prepared by repeating a cycle comprising a cold rolling and an annealing in the same manner as in Example 1 with the use of the respective hot coil from which the alloy sheets No. 1, 7 and 10 were prepared in Example 1. Then, upon the final temper rolling, a surface roughness as shown in Table 6 was imparted to the both surfaces of the thus prepared material sheet by means of the dull rolls described later, which were incorporated into the temper rolling mill, thereby manufacturing each of the Fe-Ni alloy sheets Nos. 36 to 47 for a shadow mask having a thickness of 0.25 mm. More specifically, the alloy sheets Nos. 36 to 40 were manufactured from the hot coil for the alloy sheet No. 1; the alloy sheets Nos. 41 to 46 were manufactured from the hot coil for the alloy sheet No. 7; and the alloy sheet No. 47 was manufactured from the hot coil for the alloy sheet No. 10.

The dull rolls had different values of surface roughness from each other, which included a center-line mean roughness (Ra) of from 0.45 to 1.00 μm, a kurtosis (Rkr) of from 3 to 12, and an average peak interval (Sm) of from 40 to 200 μm of the sectional curve.

The manufacturing conditions of the dull rolls and the rolling conditions of the material sheet for the Fe-Ni alloy sheet by the dull rolls were the same as those in Example 1.

Investigation of the silicon segregation rate for each of the alloy sheets Nos. 36 to 47, which was carried out in the same manner as in Example 1, revealed that the silicon segregation rate was within a range of from 4 to 7% in all cases. Then, a flat mask was manufactured by forming holes on each of the alloy sheets Nos. 36 to 47 through the etching-piercing to investigate etching pierceability in the same manner as in Example 1. Then, 50 flat masks were piled up and annealed at a temperature shown in Table 6 to investigate the occurrence of seizure of the flat masks during the annealing thereof. The results are shown in Table 6.

TABLE 6

| | | | Surface roughness | | | | | | |
|---|---|---|---|---|---|---|---|---|---|
| Alloy | Alloy sheet No. | Si Segregation rate (%) | Ra(L) (μm) | Ra(C) (μm) | Rkr(L) | Rkr(C) | \|Ra(L) − Ra(C)\| (μm) | \|Rkr(L) − Rkr(C)\| | (Ra) + 1/15 (Rkr) − 0.6 |
| A | 36 | 4 | 0.60 | 0.65 | 4.5 | 4.1 | 0.05 | 0.4 | Positive |
| | 37 | 6 | 0.55 | 0.75 | 3.8 | 4.2 | 0.20 | 0.4 | Positive |
| | 38 | 7 | 0.60 | 0.70 | 5.0 | 5.6 | 0.10 | 0.6 | Positive |
| | 39 | 7 | 0.45 | 0.65 | 4.1 | 5.0 | 0.20 | 0.9 | Positive |
| | 40 | 7 | 0.45 | 0.65 | 4.1 | 5.0 | 0.20 | 0.9 | Positive |
| B | 41 | 4 | 0.65 | 0.60 | 3.7 | 3.5 | 0.05 | 0.2 | Positive |
| | 42 | 4 | 0.65 | 0.60 | 3.7 | 3.5 | 0.05 | 0.2 | Positive |
| | 43 | 4 | 0.55 | 0.55 | 3.8 | 4.0 | 0.00 | 0.2 | Positive |
| | 44 | 4 | 0.55 | 0.55 | 3.8 | 4.0 | 0.00 | 0.2 | Positive |
| | 45 | 4 | 0.70 | 0.65 | 4.0 | 3.6 | 0.05 | 0.1 | Positive |
| | 46 | 4 | 0.70 | 0.65 | 4.0 | 3.6 | 0.05 | 0.1 | Positive |

TABLE 6-continued

| E | 47 | 2 | 0.65 | 0.60 | 6.5 | 6.3 | 0.05 | 0.2 | Positive |
|---|---|---|---|---|---|---|---|---|---|
| | | | Surface roughness | | | | | | |
| | | | Sm(L) (μm) | Sm(C) (μm) | \|Sm(L)—Sm(C)\| (μm) | Rθa (radian) | Etching pierceability | Seizure during annealing | Annealing temperature (°C.) |
| | | A | 105 | 104 | 1 | 0.045 | ⊚ | ○ | 950 |
| | | | 90 | 93 | 3 | 0.037 | ⊚ | Δ | 950 |
| | | | 132 | 130 | 2 | 0.048 | ⊚ | Δ | 950 |
| | | | 94 | 96 | 2 | 0.039 | ⊚ | Δ | 950 |
| | | | 102 | 106 | 4 | 0.039 | ⊚ | ○ | 900 |
| | | B | 90 | 95 | 5 | 0.025 | ⊚ | ○ | 850 |
| | | | 81 | 82 | 1 | 0.025 | ⊚ | Δ | 900 |
| | | | 147 | 144 | 3 | 0.054 | ⊚ | ○ | 850 |
| | | | 154 | 151 | 3 | 0.054 | ⊚ | Δ | 900 |
| | | | 93 | 98 | 5 | 0.045 | ⊚ | Δ | 900 |
| | | | 93 | 98 | 5 | 0.045 | ⊚ | Δ | 950 |
| | | E | 120 | 121 | 1 | 0.040 | ⊚ | ○ | 950 |

As is clear from Table 6, the alloy sheets Nos. 36 and 47 have a silicon content, a silicon segregation rate and a surface roughness all within the scope of the present invention. In addition, the alloy sheet No. 36 has a sulfur content of 0.0005 wt. % and the alloy sheet No. 47 has a sulfur content of 0.0006 wt. %.

These alloy sheets Nos. 36 and 47 are therefore very excellent in etching pierceability, with no occurrence of seizure of the flat mask even at an annealing temperature of 950° C.

The alloy sheet No. 46 has in contrast a silicon content, a silicon segregation rate and a surface roughness all within the scope of the present invention, but has a sulfur content of 0.0025 wt. %, which is larger than those in the alloy sheets Nos. 36 and 47. The alloy sheet No. 46 is therefore very excellent in etching pierceability with however the occurrence of seizure of the flat mask on part of the surface thereof at an annealing temperature of 950° C.

This suggests that, even when the silicon content, the silicon segregation rate and the surface roughness are within the scope of the present invention, seizure of the flat mask can be prevented by reducing the sulfur content if a high annealing temperature of the flat mask is to be maintained.

The alloy sheet No. 40, in which the center-line mean roughness (Ra) and the kurtosis (Rkr) in two directions are large outside the scope of the present invention and the other conditions are within the scope of the present invention, is very excellent in etching pierceability and shows no occurrence of seizure of the flat mask at an annealing temperature of 900° C.

The alloy sheet No. 39, on the other hand, in which the center-line mean roughness (Ra) and the kurtosis (Rkr) in two directions are similar to those in the alloy sheet No. 40, while being very excellent in etching pierceability, shows occurrence of seizure of the flat mask on part of the surface thereof at an annealing temperature of 950° C. higher than that in the alloy sheet No. 40.

The alloy sheet No. 37, in which the values of center-line mean roughness (Ra) in two directions are large outside the scope of the present invention, but all the other conditions are within the scope of the present invention, is very excellent in etching pierceability with however the occurrence of seizure of the flat mask on part of the surface thereof because of the high annealing temperature of 950° C.

The alloy sheet No. 38, in which the values of kurtosis (Rkr) in two directions are large outside the scope of the present invention, but all the other conditions are within the scope of the present invention, is excellent in etching pierceability with however the occurrence of seizure of the flat mask on part of the surface thereof because of the high annealing temperature of 950° C. as in the alloy sheet No. 37.

Therefore, it is necessary to limit the center-line mean roughness (Ra) and the kurtosis (Rkr) in two directions within the scope of the present invention when the flat masks are annealed at a high temperature.

In the alloy sheets Nos. 41 and 42, the average angle of inclination (Rθa) of the roughness curve is small outside the scope of the present invention, but all the other conditions are within the scope of the present invention. The alloy sheet No. 41, annealed at a temperature of 850° C., shows no seizure of the flat mask. The alloy sheet No. 42, on the other hand, annealed at a temperature of 900° C., shows seizure of the flat mask on part of the surface thereof.

In the alloy sheets Nos. 43 and 44, the average angle of inclination (Rθa) of the roughness curve is large outside the scope of the present invention, but all the other conditions are within the scope of the present invention. The alloy sheet No. 43, annealed at a temperature of 850° C., shows no seizure of the flat mask. The alloy sheet No. 44, on the other hand, annealed at a temperature of 900° C., shows seizure of the flat mask on part of the surface thereof.

The alloy sheet No. 45, in contrast, in which all the conditions including the average angle of inclination (Rθa) of the roughness curve are within the scope of the present invention, shows no seizure of the flat mask even at an annealing temperature of 900° C.

Even with the same sulfur content, the critical annealing temperature at which seizure of the flat mask does not occur can be increased by maintaining the average angle of inclination (Rθa) of the roughness curve within the scope of the present invention.

According to the present invention, as described above in detail, it is possible to obtain an Fe-Ni alloy sheet for a shadow mask, which is excellent in etching pierceability and permits certain prevention of seizure during the annealing of the Fe-Ni alloy sheet, by limiting the silicon content, the silicon segregation rate and the surface roughness within appropriate ranges, thus providing industrially useful effects.

What is claimed is:

1. An Fe-Ni alloy sheet for a shadow mask, which consists essentially of:

nickel: from 34 to 38 wt. %, silicon: from 0.01 to 0.15 wt. %,
manganese: from 0.01 to 1.00 wt. %, and
the balance being iron and incidental impurities;
the surface portion of said alloy sheet having a silicon (Si) segregation rate, as expressed by the following formula, of up to 10%:

$$\left|\frac{\left(\begin{matrix}\text{Si concentration in}\\ \text{segregation region}\end{matrix}\right)-\left(\begin{matrix}\text{average Si}\\ \text{concentration}\end{matrix}\right)}{(\text{Average Si concentration})}\right| \times 100;$$

and
said alloy sheet having a surface roughness which satisfies all the following formulae (1) to (3);

$$0.3\ \mu m \leqq Ra \leqq 0.8\ \mu m \quad (1)$$

where, Ra: center-line mean roughness;

$$3 \leqq Rkr \leqq 7 \quad (2)$$

where, Rkr: kurtosis which is a sharpness index in the height direction of the roughness curve; and $$Ra \geqq -\frac{1}{15} Rkr + 0.6 \quad (3)$$

2. An Fe-Ni alloy sheet for a shadow mask as claimed in claim 1, wherein:
said surface roughness of said alloy sheet further satisfies at least one of the following formulae (4) to (7):

$$70\ \mu m \leqq Sm \leqq 160\ \mu m \quad (4)$$

where, Sm: average peak interval of the sectional curve;

$$\left.\begin{matrix}|Ra(L) - Ra(C)| \leqq 0.1\ \mu m\\ |Rkr(L) - Rkr(C)| \leqq 0.5\end{matrix}\right\} \quad (5)$$

where,
Ra(L): center-line mean roughness of said alloy sheet in the rolling direction,
Ra(C): center-line mean roughness of said alloy sheet in the crosswise direction to the rolling direction,
Rkr(L): kurtosis of said alloy sheet in the rolling direction, and
Rkr(C): kurtosis of said alloy sheet in the crosswise direction to the rolling direction;

$$\left.\begin{matrix}70\ \mu m \leqq Sm \leqq 160\ \mu m\\ |Ra(L) - Ra(C)| \leqq 0.1\ \mu m\\ |Rkr(L) - Rkr(C)| \leqq 0.5\\ |Sm(L) - Sm(C)| \leqq 5.0\ \mu m\end{matrix}\right\} \quad (6)$$

where,
Sm: average peak interval of the sectional curve,
Ra(L): center-line mean roughness of said alloy sheet in the rolling direction,
Ra(C): center-line mean roughness of said alloy sheet in the crosswise direction to the rolling direction,
Rkr(L): kurtosis of said alloy sheet in the rolling direction,
Rkr(C): kurtosis of said alloy sheet in the crosswise direction to the rolling direction,
Sm(L): average peak interval of said alloy sheet in the rolling direction, and
Sm(C): average peak interval of said alloy sheet in the crosswise direction to the rolling direction; and $$0.03\ \text{radian} > R\theta a \leqq 0.05\ \text{radian} \quad (7)$$

where,
$R\theta a$: average angle of inclination of the roughness curve.

3. A method for manufacturing an Fe-Ni alloy sheet for a shadow mask, which comprises the steps of:
preparing an Fe-Ni alloy sheet consisting essentially of:
nickel: from 34 to 38 wt. %,
silicon: from 0.01 to 0.15 wt. %,
manganese: from 0.01 to 1.00 wt. %, and
the balance being iron and incidental impurities
adjusting a silicon (Si) segregation rate, as expressed by the following formula, of the surface portion of said alloy sheet during said preparation of said alloy sheet to up to 10%:

$$\left|\frac{\left(\begin{matrix}\text{Si concentration in}\\ \text{segregation region}\end{matrix}\right)-\left(\begin{matrix}\text{average Si}\\ \text{concentration}\end{matrix}\right)}{(\text{Average Si concentration})}\right| \times 100;$$

and
imparting a surface roughness which satisfies all the following formulae (1) to (3) to the both surfaces of said alloy sheet by means of a pair of dull rolls during the final rolling of said alloy sheet for said preparation:

$$0.3\ \mu m \leqq Ra \leqq 0.8\ \mu m \quad (1)$$

where, Ra: center-line mean roughness;

$$3 \leqq Rkr \leqq 7 \quad (2)$$

where, Rkr: kurtosis which is a sharpness index in the height direction of the roughness curve; and $$Ra \geqq -\frac{1}{15} Rkr + 0.6. \quad (3)$$

4. A method for manufacturing an Fe-Ni alloy sheet for a shadow mask, which comprises the steps of:
preparing an Fe-Ni alloy sheet consisting essentially of:
nickel: from 34 to 38 wt. %,
silicon: from 0.01 to 0.15 wt. %,
manganese: from 0.01 to 1.00 wt. %, and
the balance being iron and incidental impurities;
adjusting a silicon (Si) segregation rate, as expressed by the following formula, of the surface portion of said alloy sheet during said preparation of said alloy sheet to up to 10%:

$$\left|\frac{\left(\begin{matrix}\text{Si concentration in}\\ \text{segregation region}\end{matrix}\right)-\left(\begin{matrix}\text{average Si}\\ \text{concentration}\end{matrix}\right)}{(\text{Average Si concentration})}\right| \times 100;$$

imparting a surface roughness which satisfies all the following formulae (1) to (3) to the both surfaces of said alloy sheet by means of a pair of dull rolls during the final rolling of said alloy sheet for said preparation:

$$0.3\ \mu m \leqq Ra \leqq 0.8\ \mu m \quad (1)$$

where, Ra: center-line mean roughness;

$$3 \leqq Rkr \leqq 7 \quad (2)$$

where, Rkr: kurtosis which is a sharpness index in the height direction of the roughness curve; and $$Ra \geqq -\frac{1}{15} Rkr + 0.6 \quad (3)$$

and said surface roughness further satisfying at least one of the following formulae (4) to (7):

$$70\ \mu m \leqq Sm \leqq 160\ \mu m \quad (4)$$

where, Sm: average peak interval of the sectional curve;

$$\left.\begin{matrix}|Ra(L) - Ra(C)| \leqq 0.1\ \mu m\\ |Rkr(L) - Rkr(C)| \leqq 0.5\end{matrix}\right\} \quad (5)$$

where,

Ra(L): center-line mean roughness of said alloy sheet in the rolling direction,

Ra(C): center-line mean roughness of said slloy sheet in the crosswise direction to the rolling direction, Rkr(L): kurtosis of said alloy sheet in the rolling direction, and Rkr(C): kurtosis of said alloy sheet in the crosswise direction to the rolling direction;

$$\left.\begin{matrix}70\ \mu m \leqq Sm \leqq 160\ \mu m\\ |Ra(L) - Ra(C)| \leqq 0.1\ \mu m\\ |Rkr(L) - Rkr(C)| \leqq 0.5\\ |Sm(L) - Sm(C)| \leqq 5.0\ \mu m\end{matrix}\right\} \quad (6)$$

where,

Sm: average peak interval of the sectional curve,

Ra(L) center-line mean roughness of said alloy sheet in the rolling direction,

Ra(C): center-line mean roughness of said alloy sheet in the crosswise direction to the rolling direction, Rkr(L): kurtosis of said alloy sheet in the rolling direction, Rkr(C): kurtosis of said alloy sheet in the crosswise direction to the rolling direction, Sm(L): average peak interval of said alloy sheet in the rolling direction, and Sm(C): average peak interval of said alloy sheet in the crosswise direction to the rolling direction;

and $$0.03\ \text{radian} \leqq R\theta a \leqq 0.05\ \text{radian} \quad (7)$$

where, R0a: average angle of inclination of the roughness curve.

5. A method as claimed in claim 3 or 4, wherein: said final rolling is a cold rolling.

6. A method as claimed in claim 3 or 4, wherein: said final rolling is a temper rolling.

* * * * *